US007201125B2

(12) United States Patent
Evans et al.

(10) Patent No.: US 7,201,125 B2
(45) Date of Patent: Apr. 10, 2007

(54) VALVE TRAIN FOR AN INTERNAL COMBUSTION ENGINE

(75) Inventors: Matthew Evans, Warren, MI (US); William Dammers, Greenville, SC (US); Florin Bugescu, Canton, MI (US)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/466,157

(22) Filed: Aug. 22, 2006

(65) Prior Publication Data

US 2007/0039578 A1 Feb. 22, 2007

Related U.S. Application Data

(60) Provisional application No. 60/710,256, filed on Aug. 22, 2005.

(51) Int. Cl.
*F01L 1/18* (2006.01)

(52) U.S. Cl. ..... 123/90.39; 123/90.16; 123/90.44; 74/569

(58) Field of Classification Search ..... 123/90.16, 123/90.2, 90.27, 90.31, 90.39, 90.41, 90.44; 74/559, 567, 569

See application file for complete search history.

(56) References Cited

U.S. PATENT DOCUMENTS 5,186,128 A 2/1993 Murata et al.
5,320,082 A 6/1994 Murata et al.
5,370,090 A 12/1994 Murata et al.
5,423,295 A 6/1995 Murata et al.
5,429,079 A 7/1995 Murata et al.
6,763,793 B2 7/2004 Murata et al.
7,007,650 B2 * 3/2006 Harmon ..... 123/90.44

* cited by examiner

*Primary Examiner*—Ching Chang
(74) *Attorney, Agent, or Firm*—Volpe and Koenig, P.C.

(57) ABSTRACT

A valve train for an internal combustion engine is provided, with the valve train having a switchable rocker arm assembly (1) with a plurality of rocker arms (6, 7, 8) for activating at least one gas exchange valve (2), and also having at least one camshaft (3) with differently contoured cams (4, 5) through which different adjusting displacements can be imparted to individual rocker arms of the rocker arm assembly (1). The assembly further includes a switching device (9) for selectively activating the rocker arms for driving the gas exchange valve (2) with a varying valve lift. To create a valve train in which individual gas exchange valves can be operated in different modes of operation with only a small amount of construction work and expense, the rocker arm assembly (1) has a stationary rocker arm shaft (10) on which at least two outer rocker arms (6, 7), that are in continuous contact with associated, differently contoured cams (4, 5), and a center rocker arm (8) with a lever arm extension (11) through which the gas exchange valve (2), in operative connection to one of the two outer rocker arms (6, 7), can be selectively actuated, are mounted for tilting movement. Actuatable locking pins (12, 13) are arranged on the outer rocker arms (6, 7) for sliding axially parallel to the rocker arm shaft (10), a locking pin receiver (14) is arranged on the center rocker arm (8) and positioning aids (15, 16, 17) are arranged on the outer and the center rocker arms (6, 7, 8), so that the center rocker arm (8) can be selectively force-locked to one of the two outer rocker arms (6, 7) or be deactivated.

9 Claims, 5 Drawing Sheets

VALVE TRAIN FOR AN INTERNAL COMBUSTION ENGINE

CROSS-REFERENCE TO RELATED APPLICATIONS

This application claims the benefit of U.S. application No. 60/710,256, filed Aug. 22, 2005, which is incorporated by reference herein as if fully set forth.

FIELD OF THE INVENTION

The invention concerns a valve train for an internal combustion engine, said valve train comprising a switchable rocker arm assembly comprising a plurality of rocker arms for activating at least one gas exchange valve, and also comprising at least one camshaft comprising differently contoured cams through which different adjusting displacements can be imparted to individual rocker arms of the rocker arm assembly, this assembly further comprising a switching device for selectively activating the rocker arms for driving the gas exchange valve with a varying valve lift.

BACKGROUND OF THE INVENTION

The concept of variable valve control is used and is being further developed with the aim of improving the thermal efficiency of internal combustion engines. The principle of function of this concept is based on a variation of the valve opening times and the valve lifts of the gas exchange valves, i. e. of the inlet and outlet valves. The basic principle is that larger valve lifts (high lift) and shorter opening times 'enhance the performance of the engine and enable a higher peak performance of the internal combustion engine. At the same time, however, the fuel consumption also increases while the torque available is reduced. In contrast, a small valve lift improves, in particular, the torque at low engine speeds. Through a complete switching-off of one or more valves (deactivation of a cylinder), a significant saving of fuel can be achieved. Efforts are therefore directed to optimizing valve control with a view to a favorable development of torque arid power taking into account that fuel consumption and exhaust gas generation should be as low as possible.

Known variable valve controls are realized with switchable cam follower assemblies (rocker arm, finger lever or oscillating lever assemblies) in which a multi-cam camshaft varies the valve lift of the gas exchange valve or valves. For this purpose, a plurality of lever arms that are driven by cams of different shape (sharpness) and size are provided. The size of the cams changes the adjusting displacement, and the sharpness of the cams has an influence on the opening and closing times. By switching between the lever arms, different adjusting displacements, i.e. valve lifts and/or opening and closing times are imparted to the valve in question. Through the position of the cams and a purposed adjustment of the camshaft(s), an additional influence can be exercised on the point of time and duration of opening and closing of the individual inlet and outlet valves.

A valve train with switchable rocker arms is shown in U.S. Pat. No. 6,763,793 B2. This valve train comprises two rocker arms that are mounted for tilting on a first rocker arm shaft and are driven by differently shaped cams. A piston is mounted in a cylindrical space in one of the rocker arms for sliding crosswise to the axis of the rocker arm shaft. An engaging member configured on the piston can engage with an engaging projection on the other rocker arm. Switching between an engaged position and a separated position is achieved through a switching device comprising a means for a hydraulic loading of the piston and a readjusting spring arranged within the cylindrical space.

In the engaged position, both rocker arms tilt, and the cam associated to the second rocker arm, i.e. the cam of the rocker arm with the engaging projection produces a valve lift for high engine speeds of the activated inlet or outlet valve.

In the separated position, both rocker arms tilt independently of each other, and the second rocker arm (high speed) freewheels. The cam associated to the first rocker arm, i.e. the cam of the rocker arm with the piston, now produces a valve lift for low engine speeds of the activated inlet or outlet valve.

Comparable valve trains comprising a low speed lever and a high speed lever, with a piston installed crosswise in a lever shaft, through which the two levers can engage each other are likewise known from U.S. Pat. Nos. 5,186,128, 5,320,082, 5,370,090, 5,423,295 and 5,429,079.

A drawback of the prior art is that the construction of these cam follower assemblies, particularly the crosswise installation of the piston in the cylindrical space, is relatively complex. An additional requirement is an anti-rotation device that fixes the piston in an aligned position. Moreover, each cylinder requires a separate rocker arm shaft, so that the complexity and costs of installation and for a switching oil supply system increase. Besides this, each of these rocker arm shafts rotates together with the high speed lever concerned, so that the overall inertia of rotation of the valve train increases. Finally, a gas exchange valve operated through such an arrangement can only be switched between a high speed setting and a low speed setting. A valve deactivation of the gas exchange valve concerned necessitates additional measures.

SUMMARY

It is an object of the invention to provide a valve train for an internal combustion engine in that, with a relatively small amount of construction work and expense individual gas exchange valves can be operated in different modes of operation, particularly in a high lift mode, a low lift mode and a switched-off mode.

This and other objects and advantages of the invention will become obvious from the following detailed description.

The invention is based on the knowledge that for obtaining the most effective and, at the same time fuel-saving operation possible with a variable valve control for an internal combustion engine, it is appropriate to operate and deactivate individual gas exchange valves sequentially with different valve lifts, and that this can be achieved with a switchable rocker arm assembly that can be switched through a switching device between a large valve lift (high lift) and a small valve lift (low lift) as well as no valve lift (lift-less). The invention is further based on the knowledge that it is comparatively simple to manufacture a switching device comprising three rocker arms mounted for tilting on a rocker arm shaft that produce different valve lifts or no valve lift, as the case may be. and further comprising actuatable locking elements arranged parallel to the rocker arm shaft for locking the rocker arms.

The basic idea of the invention is therefore a valve train for an internal combustion engine, said valve train comprising a switchable rocker arm assembly comprising a plurality of rocker arms for activating at least one gas exchange valve, and also comprising at least one camshaft comprising differently contoured cams through which different adjusting displacements can be imparted to individual rocker arms of the rocker arm assembly, this assembly further comprising a switching device for selectively activating the rocker arms for driving the gas exchange valve with a varying valve lift.

A further feature of the valve train is that the rocker arm assembly comprises a stationary rocker arm shaft on which at least two outer rocker arms, that are in permanent contact with associated, differently contoured cams, and a center rocker arm comprising a lever arm extension through which the gas exchange valve, in operative connection to one of the two outer rocker arms, can be selectively actuated, are mounted for tilting, actuatable locking pins being arranged on the outer rocker arms for sliding axially parallel to the rocker arm shaft, a locking pin receiver being arranged on the center rocker arm and positioning aids being arranged on the outer and the center rocker arms, so that the center rocker arm can be selectively force-locked to one of the two outer rocker arms or be deactivated.

The inventive rocker arm assembly thus comprises two cam-actuated outer rocker arms and, situated between these, a non cam-actuated center rocker arm, that are mounted for tilting on a common rocker arm shaft. One of the outer rocker arms is in contact with a high lift cam and the other outer rocker arm is contact with a low lift cam of the camshaft. The valve motion is determined by that rocker arm that is connected through a locking pin to the center rocker arm. The outer rocker arms therefore act as auxiliary levers for the center rocker arm that, as the actual actuating lever, actuates the valve through a lever arm extension. If both locking pins are disengaged from the center rocker arm, a valve deactivation is achieved because the center rocker arm is not driven. This construction advantageously results in a simple variable valve control mechanism that can affect a high lift, a low lift and a valve or cylinder deactivation.

The arrangement of the locking pins parallel to the rocker arm shaft simplifies installation as compared to prior art valve trains in which the locking pins or locking pistons extend perpendicular to the axis of the rocker arm shaft. In addition, the locking pins can rotate freely in their respective receiver bore and do not require any anti-rotation device.

According to a further feature of the invention, the positioning aids arranged on the outer rocker arms may be configured as spring elements that are supported on the side of the rocker arm assembly turned away from the switching device and on an adjacent component of the internal combustion engine. The positioning aid arranged on the center rocker arm may be configured as a stop that is supported on the camshaft.

The positioning aids guarantee that the rocker arms are always aligned to one another, so that alternating locking and unlocking is possible. Or, the outer rocker arms this can be realized in a simple manner through the spring elements that are preferably configured as coil torsion springs. In the form of so-called lost motion springs, these springs control the movement of the outer rocker arms when these are not connected to the center rocker arm. The stop on the center rocker arm is a simple means of fixing this rocker arm in the correct re-activation position and thus of assuring alignment to the locking pins so that the center rocker arm can be locked again after valve deactivation.

According to a further provision of the invention, the locking pins may be configured as cylindrical pistons that are guided in bores within the rocker arms, each bore continues into a cylindrical shell extension at an end oriented towards the center rocker arm, and the locking pin receiver is configured as a semi- shell-shaped projection on the center rocker arm, which semi-shell-shaped projection cooperates with the shell extensions.

While cooperating with the shell extensions and the shell projection on the center rocker arm, the locking pins are subjected mainly to radial compressive force loading. Through this type of compressive loading, the components of the switching device adjoining one another are subjected to a lesser loading than in systems in which the locking pins are rather loaded by shearing forces.

According to another feature of the invention, adjusting springs may be associated to the locking pins to displace the locking pins into their respective initial positions. This guarantees that a reliable locking and unlocking is effected through the locking pin concerned at every switching event.

It is further possible to configure the rocker arm shaft as a common shaft that carries a larger number of rocker arms for actuating a plurality of gas exchange valves of one or more cylinders of an internal combustion engine. In the rocker arm assembly of the invention, a common rocker arm shaft can be used for a plurality of cylinders. This results in an assembly that is simpler than systems that require separate rocker arm shafts.

The common rocker arm shaft is particularly advantageous for hydraulically controlled locking pins because an appropriate switching oil supply system for actuating rocker arm locking for a plurality of cylinders can be realized in a simpler manner. However, in place of a hydraulic actuation of the switching device, it is basically also possible to use other methods of actuation, for example, electromagnetic control. In addition, due to the fact that the rocker arm shaft is stationary, the inertia of rotation of the entire system is reduced as compared to rocker arm shafts that rotate together with one or more rocker arms.

The inventive rocker arm assembly can be used particularly advantageously in a modern internal combustion engine having two overhead camshafts, a first rocker arm shaft carrying all the rocker arms that activate the gas exchange valves that are configured as inlet valves, and a second rocker arm shaft carrying all the rocker arms that activate the gas exchange valves that are configured as exhaust valves.

According to still another feature of the invention, the outer rocker arms may be configured as roller rocker arms comprising track rollers through which the associated cams transmit their respective adjusting displacement to the rocker arms. The rollers help to reduce the frictional resistance during the activation of the rocker arms through the cams.

According to a final aspect of the invention, a plurality of gas exchange valves may be actuated through the center rocker arm. For this purpose, the lever arm can comprise an appropriately configured extension that acts on the intended gas exchange valves. This is a particularly simple means of enabling the use of the rocker arm assembly for cylinders comprising a plurality of inlet and outlet valves.

The invention will now be described more closely in the following with reference to a few exemplary embodiments and the appended drawings.

DETAILED DESCRIPTION OF THE PREFERRED EMBODIMENTS

Figure 1:
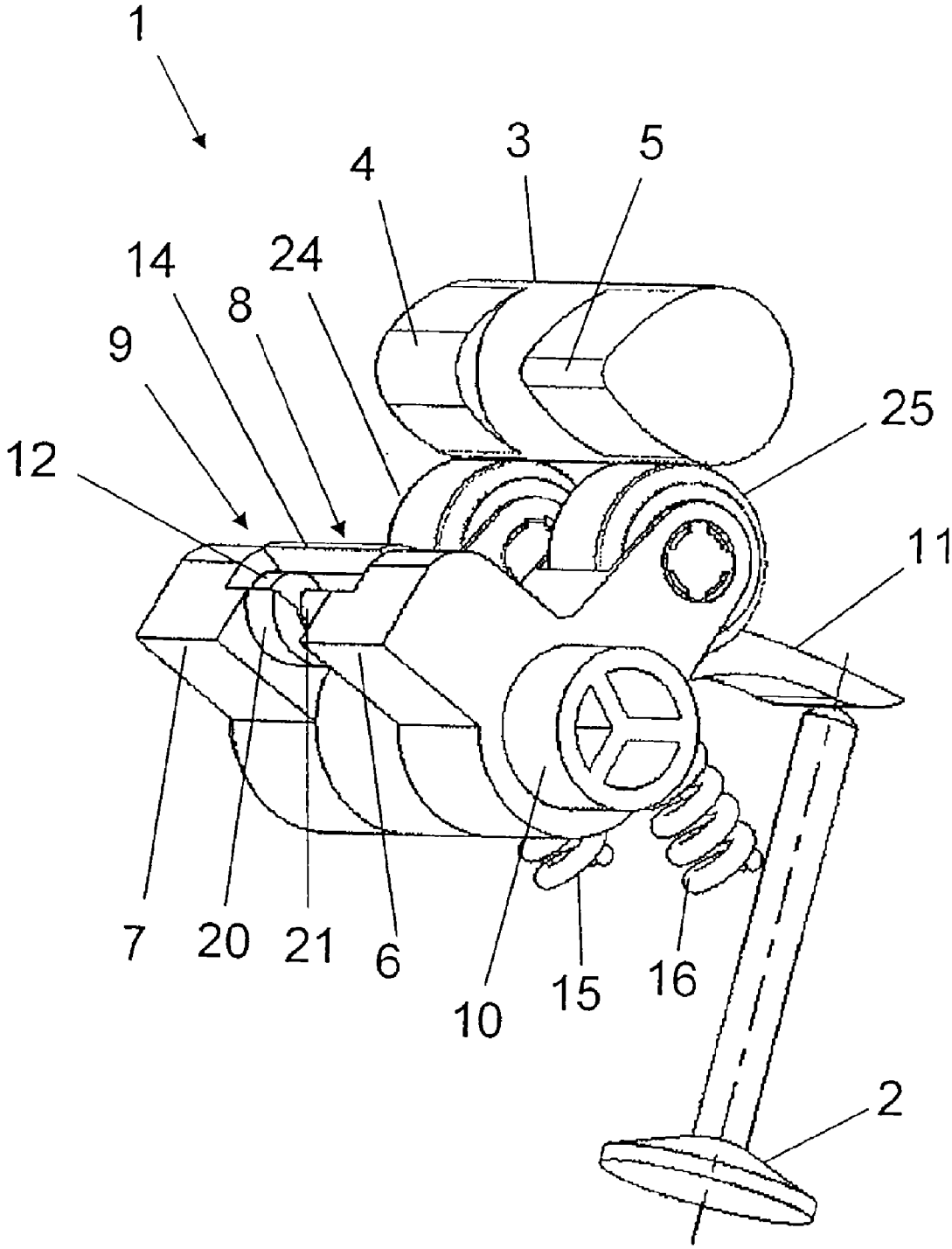
FIG. 1 is a three-dimensional view of a valve train of the invention comprising a switchable rocker arm assembly, in a first state of switching.

The valve train of an internal combustion engine in an automotive vehicle shown in FIG. 1 comprises a switchable rocker arm assembly 1 that comprises three individual rocker arms 6, 7, 8 mounted for tilting on a rocker arm shaft 10. The first rocker arm 6 is configured as an outer rocker arm that can be operated by a cam 5 of a camshaft 3. The cam 5 possesses a relatively sharp contour that produces a relatively large adjusting displacement, i.e. an ample tilting of the rocker arm 6 about the rocker arm shaft 10.

The second rocker arm 7 is configured as a second outer rocker arm that can be operated by a cam 4 having a relatively blunt contour that produces a smaller adjusting displacement, that is to say, a smaller tilting of the rocker arm 7. Adjacent to the cams 4 and 5, two rollers 24, 25 are mounted for rotation on the outer rocker arms 6 and 7, on which rollers 24, 25, the cams 4, 5 run in permanent contact during operation.

A center rocker arm 8 serves as the actual actuating lever for the gas exchange valve 2. For this purpose, the rocker arm 8 comprises a lever arm extension 11 through which the valve 2 can be actuated.

The rocker arm assembly 1 comprises a switching device 9 (FIG. 2) through which the outer high lift rocker arm 6 and the outer low lift rocker arm 7 can be brought selectively into engagement with the center actuating rocker arm 8. For this purpose, locking pins 12, 13 are arranged on the rocker arms 6, 7 for displacement parallel to the axis of the rocker arm shaft 10 into bores 18, 19.

The locking pins 12, 13 are configured as cylindrical pistons and comprise circumferential edges 26, 27. Inwardly extending stops 28, 29 for the edges 26, 27 are configured on the bores 18, 19 for limiting the adjusting displacement of the pistons 12, 13 Out of the bores 18, 19. Within the bores 18, 19, a respective adjusting spring 22, 23, advantageously configured as a coil compression spring, is associated to each piston 12, 13.

Figure 3:
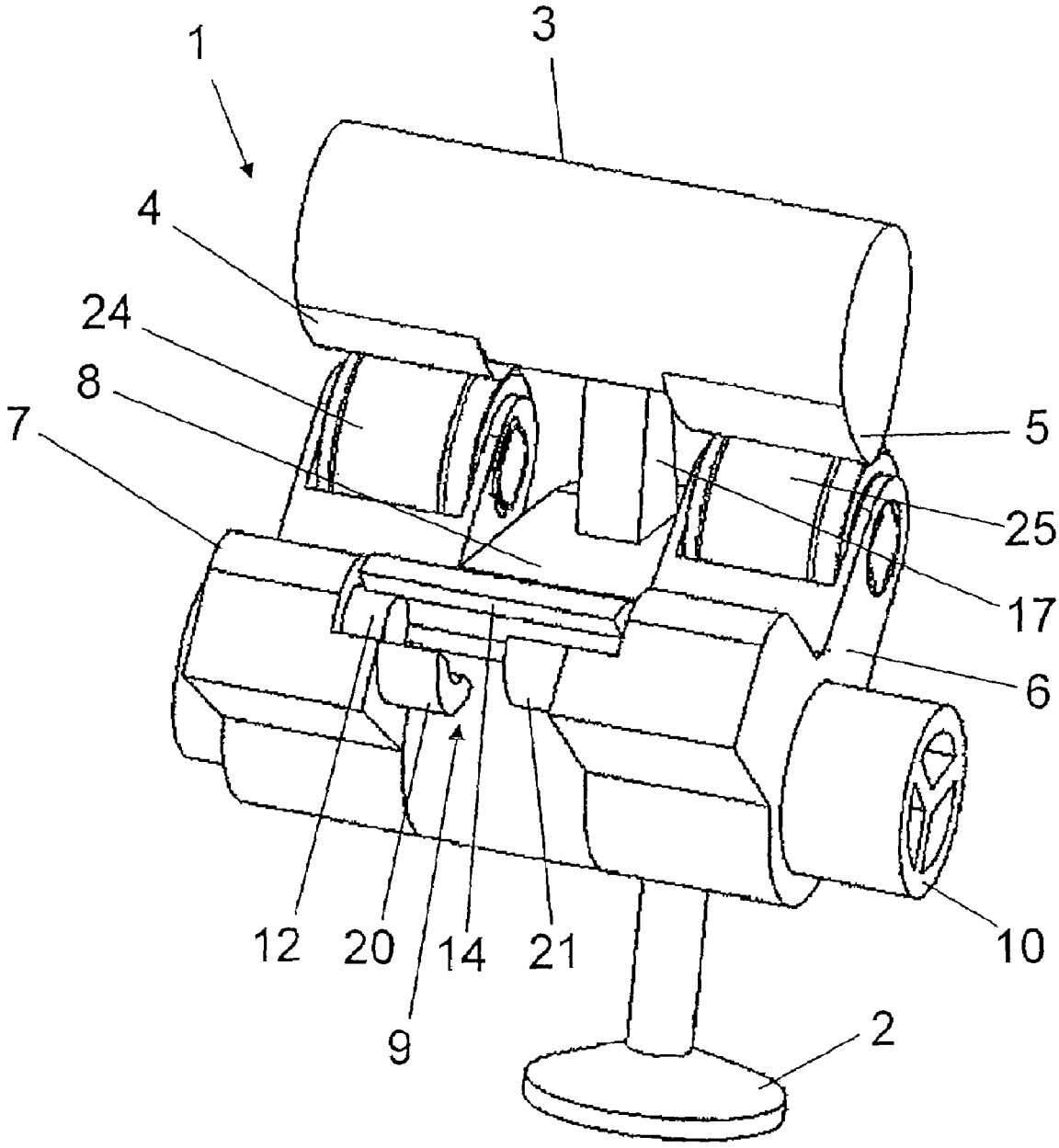
FIG. 3 is another perspective view of the valve train of FIG. 1.

The bores 18, 19 open into shell extensions 20, 21 in which the pistons 12, 13 are guided outside of the bores 18, 19 (FIG. 3). To effect a displacement of the pistons 12, 13 into the bores 18, 19 against the restoring force of the readjusting springs 22, 23, the pistons 12, 13 can be axially loaded with hydraulic oil by a hydraulic control device, not shown.

The center rocker arm 8 comprises a locking pin receiver 14 that is configured as a cylindrical semi-shell and is situated opposite the shell extensions 20, 21.

So-called lost motion springs 15 16 are arranged on the outer rocker arms 6, 7 on the side of the rocker arm assembly 1 turned away from the switching device 9. These spring elements, advantageously configured as coil compression springs, are supported between the rocker arms 6, 7 and a machine part, not shown, and serve as positioning aids to control the movement of the rocker arms 6, 7 when they are not engaged with the center rocker arm 8.

A further positioning aid in the form of a stop 17, advantageously configured with a wedge (FIG. 3), is arranged on the center rocker arm 8. When the center rocker arm 8 is free, i.e. when it is not engaged with the high lift rocker arm 6 or with the low lift rocker arm 7, the stop 17 is supported on the camshaft 3 and the lever arm extension 11 is supported on the valve 2. In this way, in operative cooperation with the lost motion springs 15, 16, the center rocker arm 8 is fixed in a re-activation position that assures the correct alignment of the bores 18, 19 of the locking pins 12, 13.

The mode of functioning of the rocker arm assembly is explained in the following:

A locking between one of the outer rocker arms 6, 7 and the center rocker arm 8 is effected by the fact that the respective locking pin 12, 13 is displaced hydraulically out of its bore 18, 19. The pin 12, 13 is pushed between the receiver 14 and the extension 20, 21, so that the parting gap between the respective rocker arms 6 and 8, or 7 and 8, is bridged and engagement effected. Following this, a tilting motion of the engaged outer rocker arm 6 or 7 is transmitted to the center rocker arm 8 that then presses the gas exchange valve 2 down with the help of the lever arm extension 11. During this process, the locking pin concerned 12, 13 is subjected to radial compressive loading by the cylindrical shells 14 and 20, 21.

Figure 2:
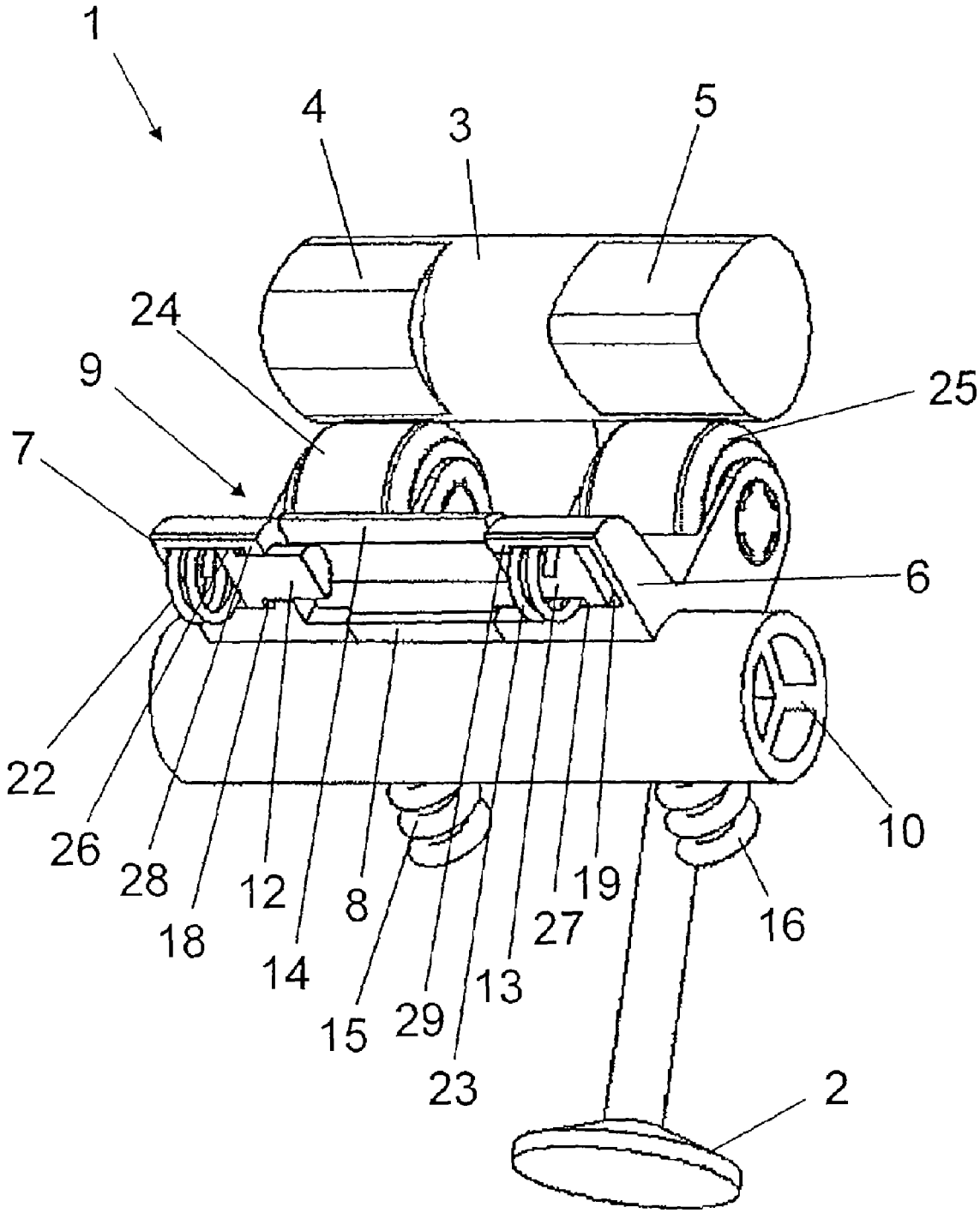
FIG. 2 shows the valve train of FIG. 1 with a longitudinal section along a switching device of the rocker arm assembly.

In the representation of FIG. 2, the piston 12 is pressed out of the bore 18 by the spring 22, whereas the opposing piston 13 is retained in the bore 19 by the spring 23. Thus, in this hydraulically pressure-less initial position, the low lift rocker arm 7 is engaged to the actuating rocker arm 8 that opens the valve 2 with the correspondingly small lift while the high lift rocker arm 8 tilts freely when operated through the cam 5 (FIG. 3).

Figure 4:
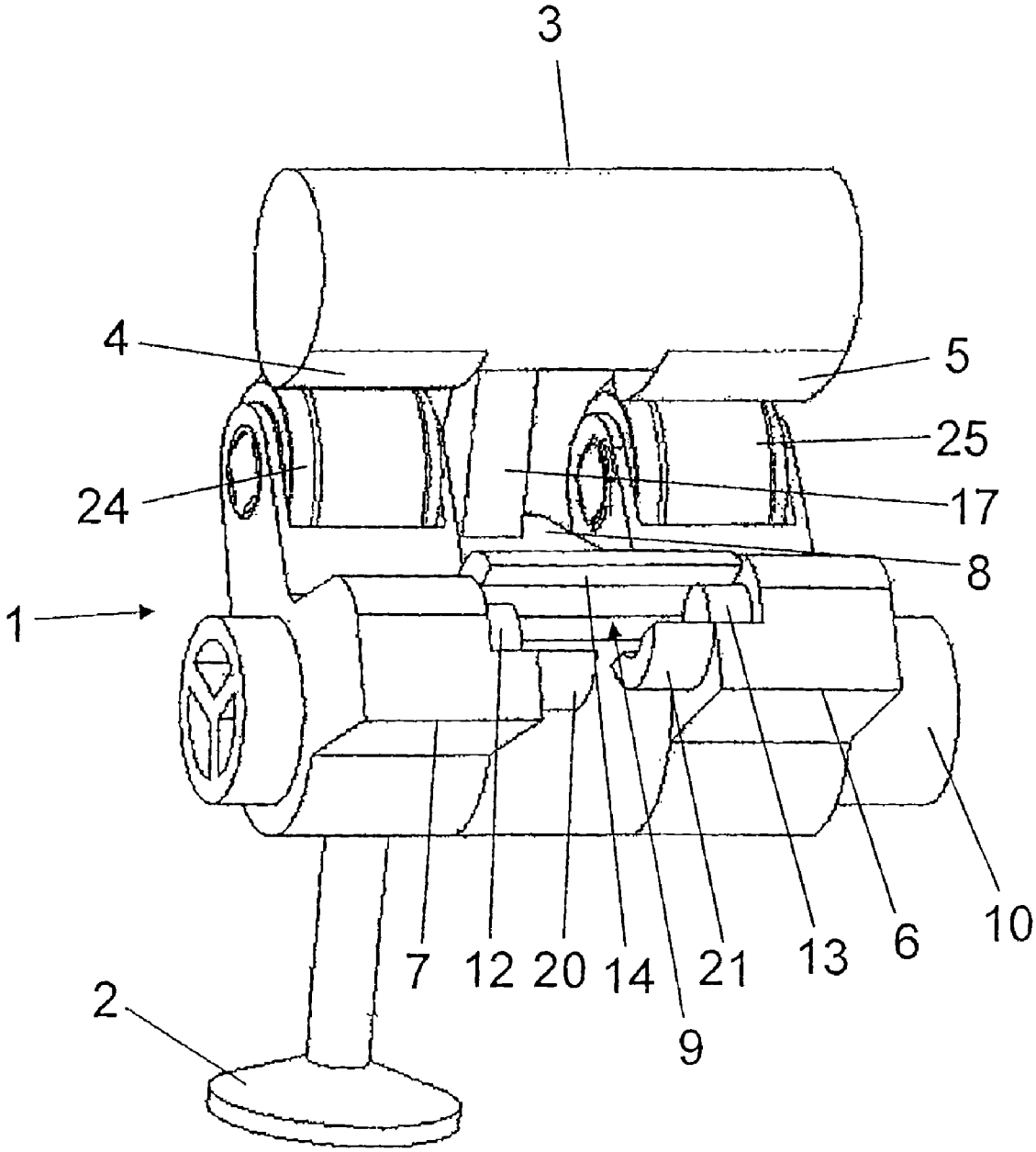
FIG. 4 shows the valve train of FIG. 1 in a second state of switching.

If the piston 13 (high lift piston) is loaded by a hydraulic force, it is displaced out of its bore 19 and comes to engage with the locking extension 14 (locking pin receiver) of the center rocker arm 8, so that a force-locked connection is established between the rocker arms 6 and 8. When the camshaft 3 rotates, the high lift rocker arm 6 is caused to rotate about the rocker arm shaft 10 by the high lift cam 5. The locking piston 13 now applies a radial compression force to the locking extension 14 of the center rocker arm 8, which force is converted into an adjusting movement that corresponds to the cam contour and opens the valve 2 and presses it downwards with the large valve lift (high lift) (FIG. 4). During this time, the low lift piston 12 can continue to protrude out of its bore 18.

But because the high lift rocker arm 6 tilts or rotates through a larger angle and the high lift cam 5 has a sharper contour than the low lift cam 4, the locking extension 14 lifts off the low lift piston 12 during this movement, so that the low lift rocker arm 7 does not transmit any force to the activating lever 8. It is also conceivable that the low lift piston 12 be hydraulically loaded at the same time as high lift piston 13, so that the low lift piston 12 is also pressed into its bore 18 and is completely unlocked from the center rocker arm 8.

Figure 5:
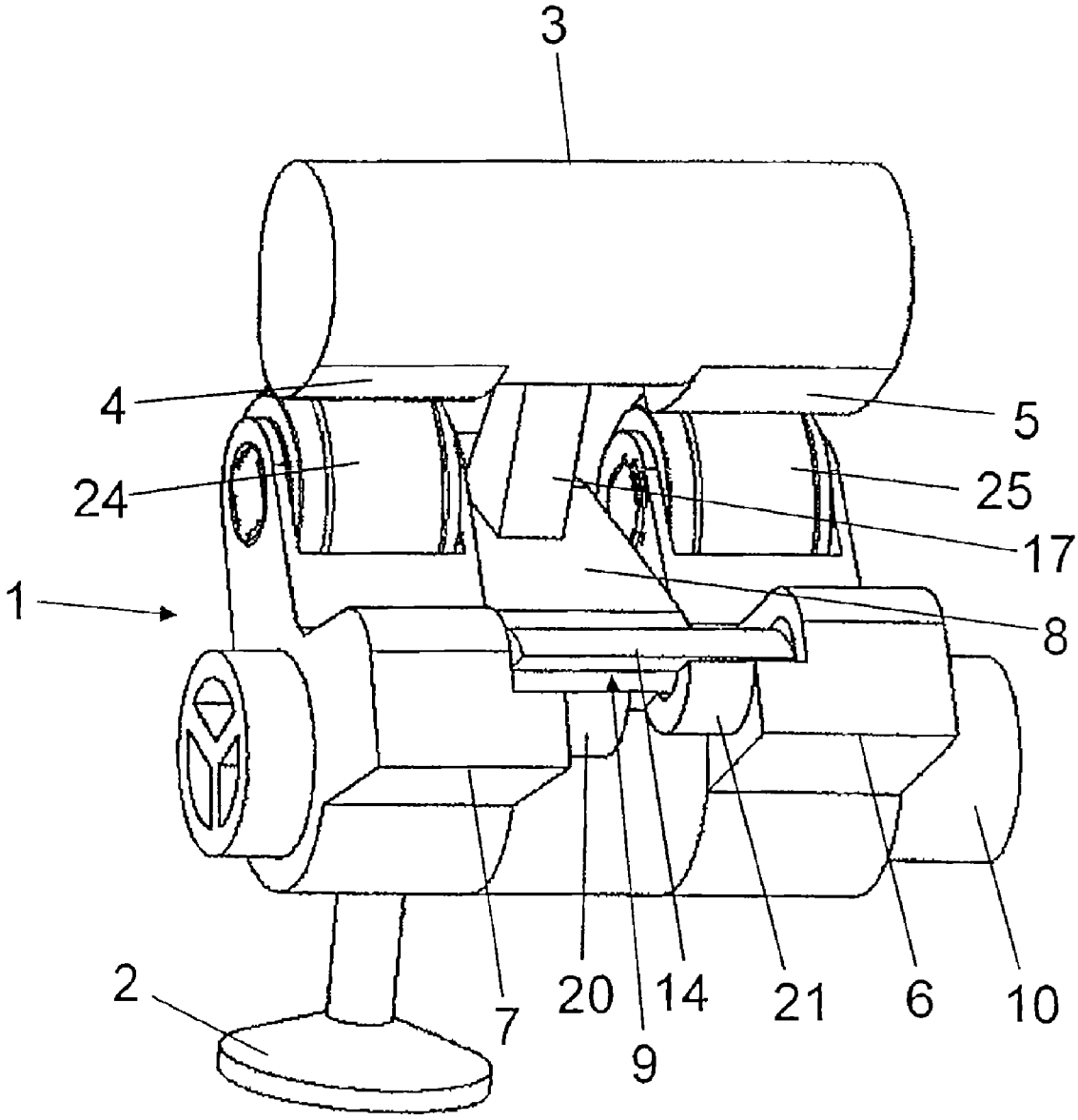
FIG. 5 shows the valve train of FIG. 1 in a third state of switching.

Besides these two switching positions, low lift and high lift, a third switching position that deactivates the valve 2 (FIG. 5) is also possible. For this purpose, only the low lift piston 12 is pressed into its bore 18 (the high lift piston 13 being already situated in its bore 19), so that neither one of the two outer rocker arms 6, 7 is engaged to the center rocker arm 8. In this case, the center rocker arm 8 (activating rocker arm) is not activated and the valve 2, is therefore, not opened.

The invention claimed is:

1. A valve train for an internal combustion engine, said valve train comprising a switchable rocker arm assembly comprising a plurality of rocker arms for activating at least one gas exchange valve, and also comprising at least one camshaft comprising differently contoured cams through which different adjusting displacements can be imparted to individual ones of the rocker arms of the rocker arm assembly, the rocker arm assembly further comprising a switching device for selectively activating the rocker arms for driving the gas exchange valve with a varying valve lift, the rocker arm assembly comprises a stationary rocker arm shaft on which the rocker arms are mounted for tilting movement and the plurality of rocker arms including at least two outer rocker arms, that are in continuous contact with associated, differently contoured cams, and a center rocker arm comprising a lever arm extension through which the gas exchange valve, in operative connection to one of the two outer rocker arms, can be selectively actuated, actuable locking pins are arranged on the outer rocker arms for sliding axially parallel to the rocker arm shaft, a locking pin receiver being arranged on the center rocker arm and positioning aids being arranged on the outer and the center rocker arms, so that the center rocker arm can be selectively force-locked to one of the two outer rocker arms or can be deactivated.

2. The valve train of claim 1, wherein the positioning aids arranged on the outer rocker arms are configured as spring elements that are supported on a side of the rocker arm assembly turned away from the switching device and on an adjacent component of the internal combustion engine.

3. The valve train of claim 2, wherein the positioning aid arranged on the center rocker arm is configured as a stop that is supported on the camshaft.

4. The valve train of claim 1, wherein the locking pins are configured as cylindrical pistons that are guided in bores within the rocker arms, each of the bores continues into a cylindrical shell extension at an end oriented towards the center rocker arm, and the locking pin receiver is configured as a semi-shell-shaped projection on the center rocker arm, which semi-shell-shaped projection cooperates with the shell extensions.

5. The valve train of claim 1, wherein adjusting springs are associated with the locking pins and displace the locking pins into a respective initial position.

6. The valve train of claim 1, wherein the rocker arm shaft, as a common shaft, carries a number of rocker arms for actuating a plurality of gas exchange valves of one or more cylinders of the internal combustion engine.

7. The valve train of claim 1, wherein the internal combustion engine comprises two overhead camshafts, a first rocker arm shaft carries the rocker arms that activate the gas exchange valves configured as intake valves and a second rocker arm shaft carries the rocker arms that activate the gas exchange valves configured as exhaust valves.

8. The valve train of claim 1, wherein the locking pins are actuatable through a hydraulic valve control device.

9. The valve train of claim 1, wherein the outer rocker arms are configured as roller rocker arms comprising track rollers through which the associated cams transmit respective adjusting displacements to the rocker arms.

* * * * *